US007255545B2

(12) United States Patent
Tien-Tung et al.

(10) Patent No.: US 7,255,545 B2
(45) Date of Patent: Aug. 14, 2007

(54) DOUBLE-LOBE TYPE ROTOR DESIGN PROCESS

(75) Inventors: Chung Tien-Tung, Taipei (TW); Lin Heng-I, Taipei Hsien (TW); Chuang Feng-Ming, Taipei Hsien (TW)

(73) Assignee: Liung Feng Industrial Co., Ltd., Taipei Hsien (TW)

( * ) Notice: Subject to any disclaimer, the term of this patent is extended or adjusted under 35 U.S.C. 154(b) by 140 days.

(21) Appl. No.: 11/214,876

(22) Filed: Aug. 31, 2005

(65) Prior Publication Data

US 2005/0287029 A1 Dec. 29, 2005

Related U.S. Application Data

(63) Continuation-in-part of application No. 10/449,080, filed on Jun. 2, 2003, now Pat. No. 6,776,594.

(51) Int. Cl.

| | |
|---|---|
| ***F01C 1/00*** | (2006.01) |
| ***F01C 1/16*** | (2006.01) |
| ***F03C 2/24*** | (2006.01) |
| ***F03C 4/00*** | (2006.01) |
| ***F04C 2/00*** | (2006.01) |
| ***F04C 18/00*** | (2006.01) |

(52) U.S. Cl. ..... 418/201.3; 418/150; 418/206.5

(58) Field of Classification Search ..... 418/201.3, 418/150, 206.5

See application file for complete search history.

(56) References Cited

U.S. PATENT DOCUMENTS

| | | | | |
|---|---|---|---|---|
| 4,430,050 | A * | 2/1984 | Blazejewski | 418/191 |
| 5,149,256 | A * | 9/1992 | Schmitz | 418/150 |
| 5,669,765 | A * | 9/1997 | Moller et al. | 418/1 |
| 5,947,713 | A * | 9/1999 | Ohman et al. | 418/201.3 |
| 6,776,594 | B1 * | 8/2004 | Heng-I et al. | 418/206.5 |

* cited by examiner

*Primary Examiner*—Thomas Denion
*Assistant Examiner*—Douglas J. Duff
(74) *Attorney, Agent, or Firm*—Troxell Law Office, PLLC

(57) ABSTRACT

A double-lobe type rotor design process includes a process for forming a defined rotor and a process for forming a conjugate rotor, wherein the defined rotor and the conjugate rotor intermesh and conjugate to each other. The rotor profile curves suitably for the completed operation period of carryover, suction and exhaust could be well defined by proper parameters, thereby optimizing rotor performance, enhancing compression ratio, providing a smooth suction and exhaust process and avoiding noise and vibration.

4 Claims, 9 Drawing Sheets

R= 60, D=85,beta=6,alpha:variable

R= 60, D=85,,alpha=3,beta:variable

FIG.4

| no. | R(mm) | D(mm) | $\alpha$ (degree) | $\beta$ (degree) | $r_b$ (mm) | $r_c$ (mm) |
|---|---|---|---|---|---|---|
| 1 | 60 | 80 | 3 | 6 | 38.89548 | 30.53638 |
| 2 | 60 | 75 | 3 | 6 | 36.25741 | 28.27297 |
| 3 | 60 | 70 | 3 | 6 | 33.61934 | 26.00956 |
| 4 | 60 | 65 | 3 | 6 | 30.98128 | 23.74615 |
| 5 | 60 | 60 | 3 | 6 | 28.34321 | 21.48274 |
| 6 | 60 | 55 | 3 | 6 | 25.70515 | 19.21933 |
| 7 | 60 | 52 | 3 | 6 | 24.12231 | 17.86129 |

FIG.5

| no. | R(mm) | D(mm) | $\alpha$ (degree) | $\beta$ (degree) | $r_b$ (mm) | $r_c$ (mm) |
|---|---|---|---|---|---|---|
| 1 | 60 | 85 | 3 | 6 | 41.53354 | 32.79979 |
| 2 | 60 | 85 | 6 | 6 | 40.45723 | 32.79979 |
| 3 | 60 | 85 | 9 | 6 | 39.25473 | 32.79979 |
| 4 | 60 | 85 | 12 | 6 | 37.90651 | 32.79979 |

FIG.8

| no. | R(mm) | D(mm) | $\alpha$ (degree) | $\beta$ (degree) | $r_b$ (mm) | $r_c$ (mm) |
|---|---|---|---|---|---|---|
| 1 | 60 | 85 | 3 | 3 | 41.53354 | 37.40236 |
| 2 | 60 | 85 | 3 | 6 | 41.53354 | 32.79979 |
| 3 | 60 | 85 | 3 | 9 | 41.53354 | 28.63452 |
| 4 | 60 | 85 | 3 | 12 | 41.53354 | 24.85721 |

FIG.8

DOUBLE-LOBE TYPE ROTOR DESIGN PROCESS

This application is a continuation-in-part application of U.S. Pat. No. 10/449,080 filed Jun. 2, 2003 now U.S. Pat. No. 6,776,594 entitled "Rotor Mechanism".

BACKGROUND OF THE INVENTION

1. Field of the Invention

The present invention relates to a double-lobe type rotor design process which is able to create a defined rotor and a conjugate rotor intermeshing and conjugating to each other from carryover to suction and from exhaust to the end of the completed operation period by different parameters, and evaluate optimal rotor profiles to be used for some systems like a vacuum pump, an air booster, a compressor and a supercharger, enhancing compression ratio, providing a smooth suction and exhaust process and avoiding noise and vibration.

A double-lobe type rotor used in multistage type vacuum pumps, compressors, air boosters or superchargers generally comprise a defined rotor and a conjugate rotor intermeshing to each other. A pair of lobes of each rotor provides periodic compression operation of gas suction and gas exhaust. Therefore, the meshing mechanism of two lobes of the rotors is very important. If the meshing mechanism of the two lobes of the rotors is not good enough, noise and vibration may occur during the periodic gas suction, gas exhaust, and carry over processes of the rotors. Moreover, wear may occur due to the improper intermeshing of the rotors thereby reducing the durability of operation.

U.S. Pat. Nos. 1,426,820, 4,138,848, 4,224,016, 4,324, 538, 4,406,601, 4,430,050 and 5,149,256 disclose relevant rotors. Referring to FIG. 9, lobes of a pair of rotors 8, 9 of U.S. Pat. No. 5,149,256 include a tip portions 82, 92 formed at ajunctions between the concave portions 80, 90 and the arcuate surfaces 81, 91 so that there is discontinuity of the rotors 80, 90 's curves. Therefore, during the moments from inefficient compression period to the period of air's starting intake, the top portions 83, 93 of the rotors 8, 9 will operate unsmoothly at the tip portion 82, 92 thereby resulting in noise and vibration.

To overcome the defects mentioned above, U.S. Pat. No. 6,776,594 provides two rotors with smooth operation curve and conjugate to each other. The main feature is that the operation curve provided by the rotors from the carryover period to the period of starting suction and from the exhaust period to the end is defined by a couple of smoothly connected curves rather than a couple of connected arc and concave curve, thereby avoiding noise and vibration during the periodic operation of suction, exhaust, and carryover, etc

SUMMARY OF THE INVENTION

Accordingly, an object of the present invention is to provide a double-lobe type rotor design process which is able to create a defined rotor and a conjugate rotor intermeshing and conjugating to each other from carryover to suction and from exhaust to the end of the completed operation period by different parameters, and evaluate optimal rotor profiles to be used for some systems like a vacuum pump, an air booster, a compressor and a supercharger, enhancing compression ratio, providing a smooth suction and exhaust process and avoiding noise and vibration.

A double-lobe type rotor design process of the present invention is adapted for forming a defined rotor and a conjugate rotor intermeshing to each other. The rotor profile curves suitably for the completed operation period of carryover, suction and exhaust could be well defined by proper parameters, thereby optimizing rotor performance, enhancing compression ratio, providing a smooth suction and exhaust process and avoiding noise and vibration.

BRIEF DESCRIPTION OF THE DRAWINGS

FIG. 8 is a list of different values of the lobes of the defined rotor and the conjugate rotor according to different parameters in FIGS. 4, 6 and 7.

DESCRIPTION OF THE PREFERRED EMBODIMENTS

Figure 1:
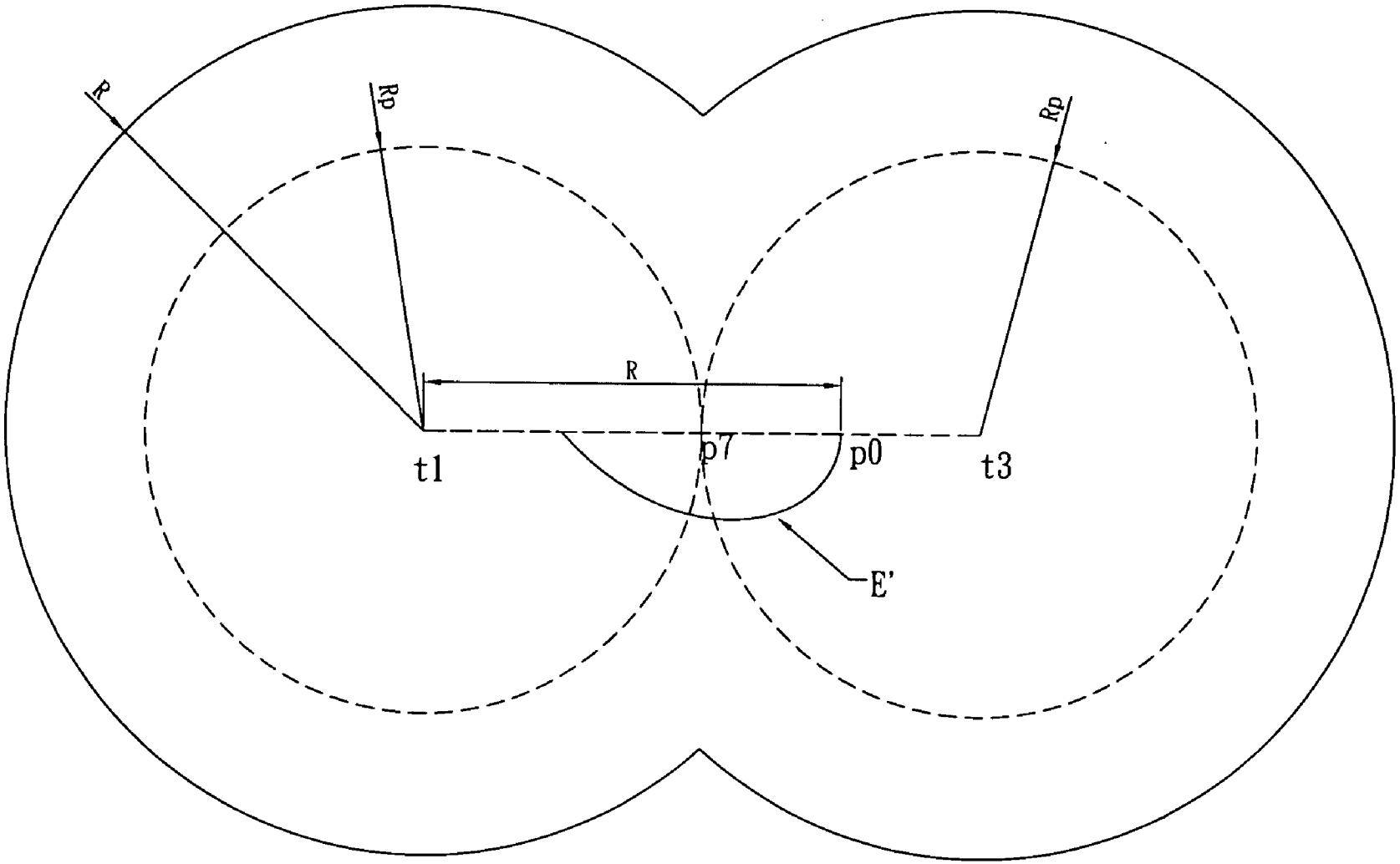
FIG. 1 is a sketch view of forming a tip conjugate curve of a lobe type rotor design process of the present invention.
Figure 2:
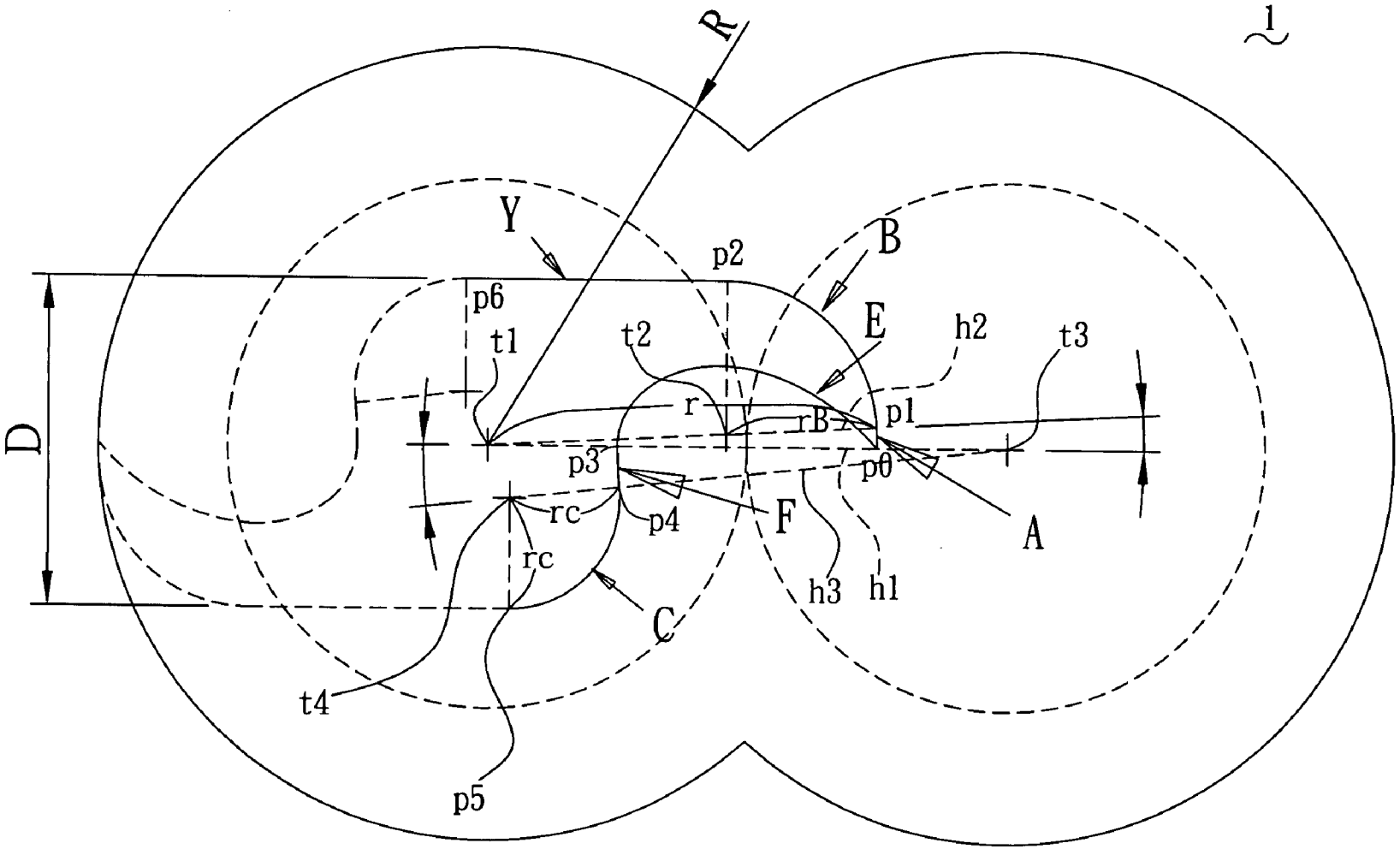
FIG. 2 is a sketch view of forming a defined rotor profile of a lobe type rotor design process.

A double-lobe type rotor design process in accordance with the present invention designs the profile of a defined rotor 1 by suitable parameters, and then get the profile of conjugate rotor 2 with conjugate theory. With reference to FIGS. 1 and 2, designing process for forming the profile of defined rotor 1 comprises the following steps:

1. Specifying maximum radius R and width D of the defined rotor 1, pitch circles of the defined rotor 1 and the conjugate rotor 2 with a pitch circle radius Rp and centers t1 and t3 respectively, wherein Rp is smaller than R by the ratio of R=3Rp/2.

2. The first pitch circle center t1 is designated as the center of the defined rotor 1. A reference horizontal line h1 is defined through the first center t1 and the third center t3 as assistant line. A base point p0 on the reference horizontal line h1 is spaced a distance R apart from the first center t1. Referring to FIG. 1, a conjugate curve E' is created when the base point p0 rotating about the first center t1. Referring to FIGS. 1 and 2, a curve E is drawn symmetrically to the conjugated curve E' about the tangent point p7 of the two pitch circles of the defined rotor 1 and the conjugate rotor 2. The curve E serves as a portion of a first lobe of the defined rotor 1. A third point p3 is an intersection of the curve E and the horizontal line h1.

3. A first point p1 on the profile of the defined rotor 1 is defined by a first central angle $\alpha$ and a circle with a center of t1 and a radius of R. A first arc A is defined between the base point p0 and the first point p1 and with a center of t1 and a radius of R.

4. A second line h2 is defined by the reference horizontal line h1 and the first central angle $\alpha$. A second center t2 is designated on the second line h2 and is spaced a distance $r_B$ apart from the first point p1.

5. The $r_B$ is defined by following equation, wherein R is the maximum radius of the defined rotor 1, namely, the distance between the first center t1 and the first point p1.

$$r_B + (R - r_B)\sin\alpha = \frac{D}{2}$$

$$r_B = \frac{D/2 - R\sin\alpha}{1 - \sin\alpha}$$

6. The second arc B is defined by a circle with a center of t2 and a radius of $r_B$, and connecting with the first point p1 and a second point p2. The second point p2 is located on a vertical line through the second center t2 and above the center point t2.

7. The third center t3 of the pitch circle of the conjugate rotor 2 is located on the reference horizontal line h1, and is spaced a distance 2Rp apart from the first center t1. A fourth point p4 is defined by a second central angle β and a circle with a center of t3 and a radius of R. A third arc F is defined by connecting with the third point p3 and the fourth point p4.

8. A third line h3 is defined by the reference horizontal line h1 and the second central angle β. A fourth center t4 is located on the third line h3 and is spaced a distance $r_C$ apart from the fourth point p4.

9. The radius $r_C$ is defined by the following equation, wherein R is the maximum radius of the defined rotor 1, namely, the distance between the center t3 and the fourth point p4.

$$r_C + (R + r_C)\sin\beta = \frac{D}{2}$$

$$r_C = \frac{D/2 - R\sin\beta}{1 + \sin\beta}$$

10. A fourth arc C is defined with a circle center of t4 and a radius of $r_C$, and connecting with the fourth point p4 and a fifth point p5. The fifth point p5 is located on a vertical line through the fourth center t4 and below the fourth center t4.

11. A second horizontal line Y is defined by connecting the second point p2 and a seventh point p6 which is symmetric to the fifth point p5 about the first center t1.

12. Smoothly connecting the curve E, the first arc A, the second arc B, the third arc F, the fourth arc C and the horizontal line Y forms a profile of a first lobe of the defined rotor 1. A profile of a second lobe of the defined rotor 1 is drafted symmetrically to that of the first lobe about the first center t1, as shown by broken line in FIG. 2.

Thus, a profile of the defined rotor 1 with two lobes is completed through the design process described above.

Figure 3:
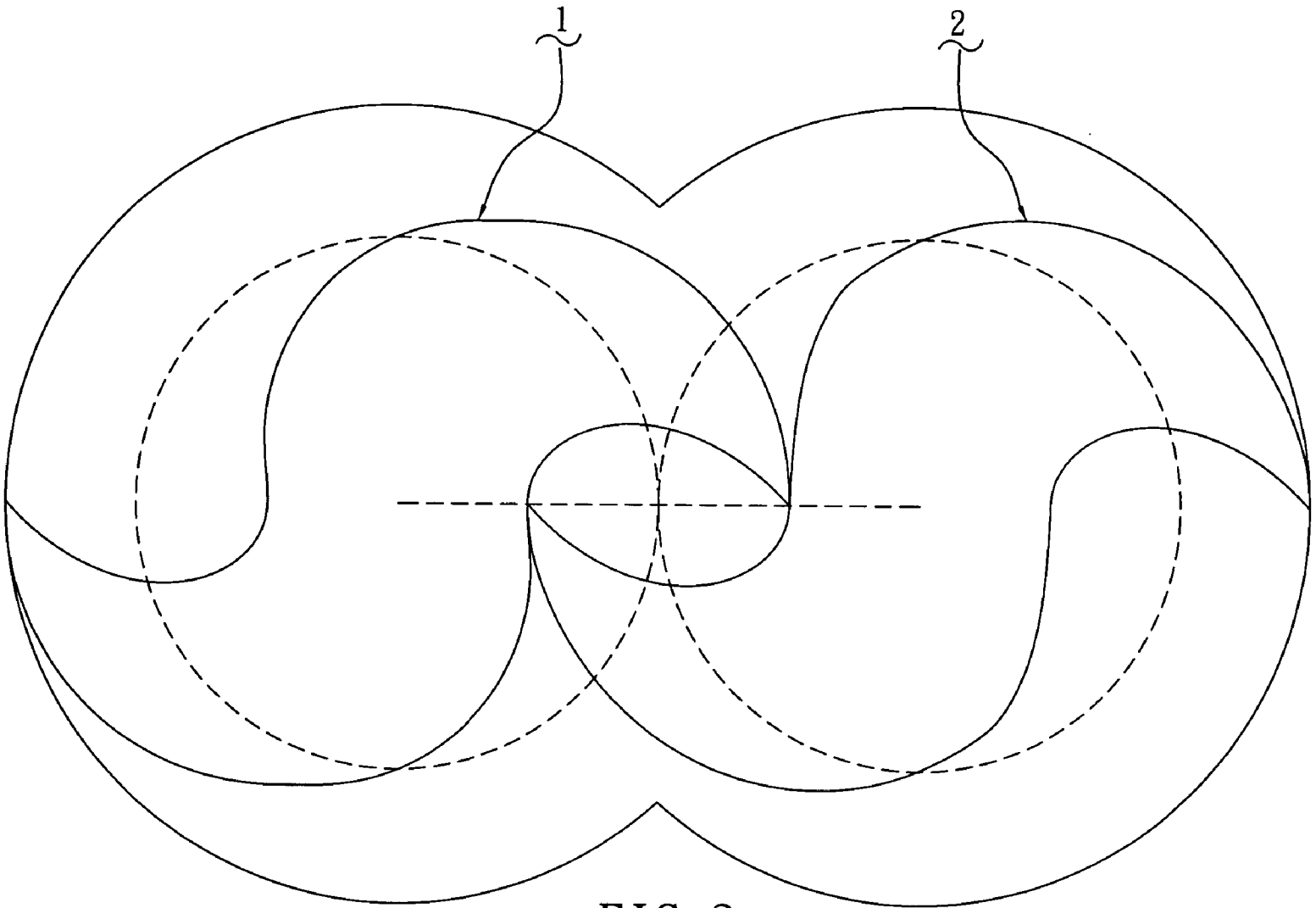
FIG. 3 is a sketch view of forming a conjugate rotor profile of a lobe type rotor design process.

Referring to FIG. 3, a profile of the conjugate rotor 2 is created by connecting the respective conjugate curves of the profile of the defined rotor 1, including the respective conjugate curves of the curve E, the first arc A, the second arc B, the third arc F, the fourth arc C and the horizontal line Y.

Figure 4:
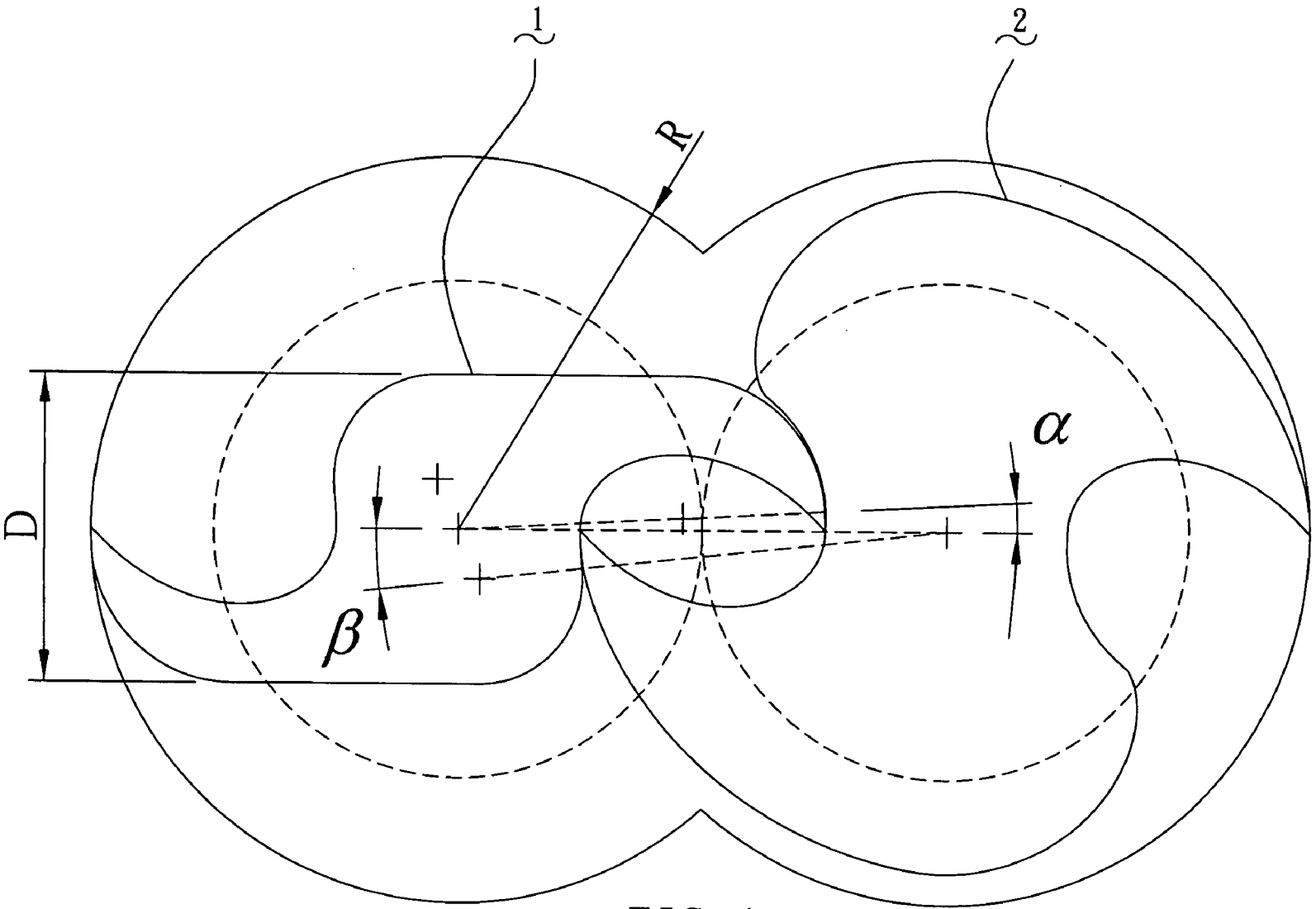
FIG. 4 is an example of a lobe type rotor design process, where the maximum diameter R of the defined rotor is 60 mm, width D thereof is 85 mm, central angle $\alpha$ thereof is 3°, central angel $\beta$ is 6°.

FIG. 4 shows an application of the present design process, where the maximum radius R of the defined rotor 1 is 60 mm, width D of the defined rotor 1 is 85 mm, the first central angle α is 3° and the second central angle β is 6°. The defined rotor 1 and the conjugate rotor 2 have generally identical profile, and therefore have similar mechanical characteristics.

Figure 5:
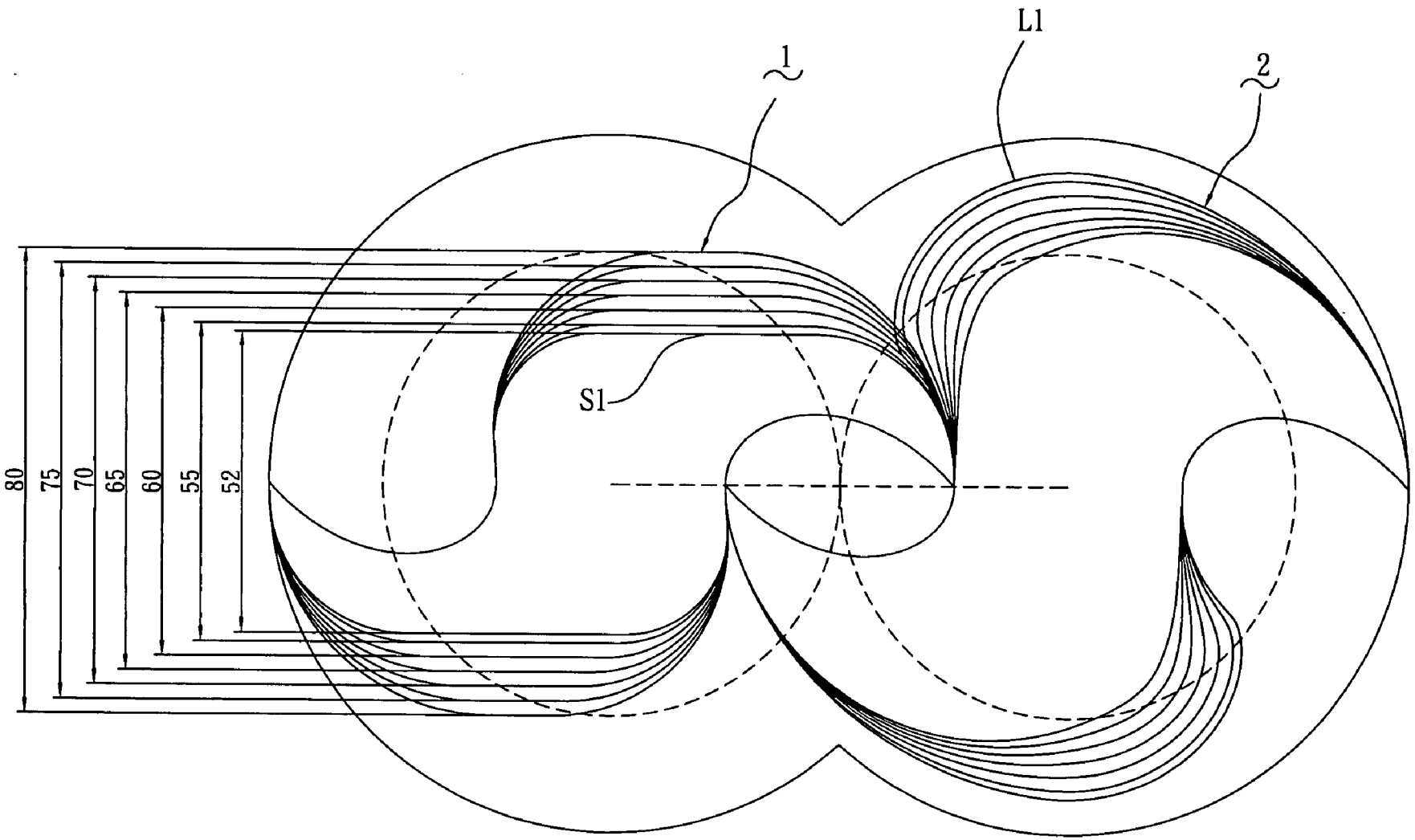
FIG. 5 is a sketch view of the defined rotor profile varying, where width D thereof is 52, 55, 60, 65, 75, 80 mm.

FIG. 5 shows some applications of the present design process, where the maximum radius R of the defined rotor 1 remains 60 mm, while the width of the defined rotor 1 is 52, 55, 60, 65, 70, 75, 80 mm, respectively. Based on conjugate characteristic, a profile of the defined rotor 1 with minimum width S1 corresponds to a profile of the conjugate rotor 2 with maximum width L1. The width D may be subject to variation in accordance with different practical applications.

Figure 6:
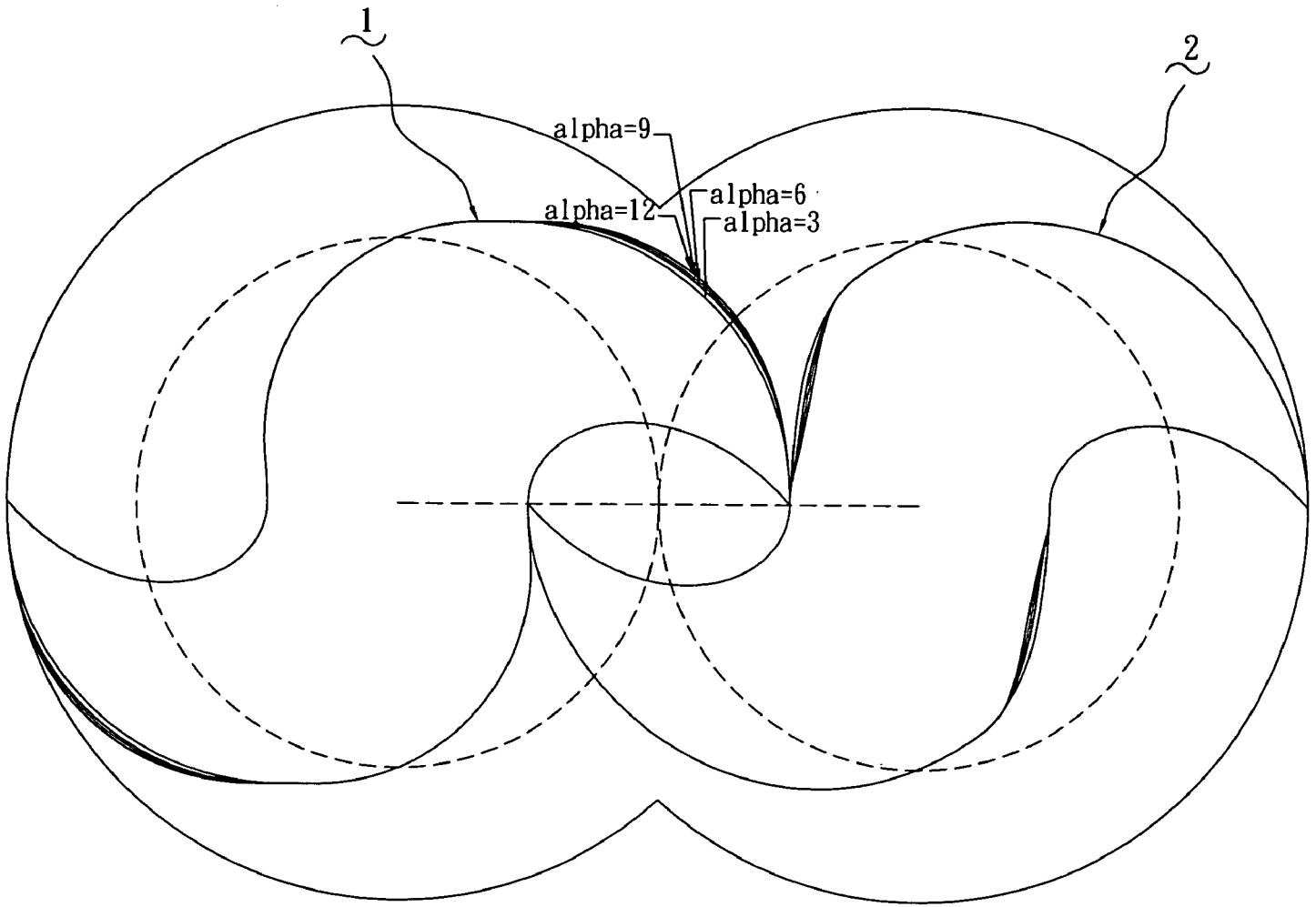
FIG. 6 is a sketch view of the defined rotor profile varying, where central angle $\alpha$ thereof is 3°, 6°, 9°, 12°.
Figure 7:
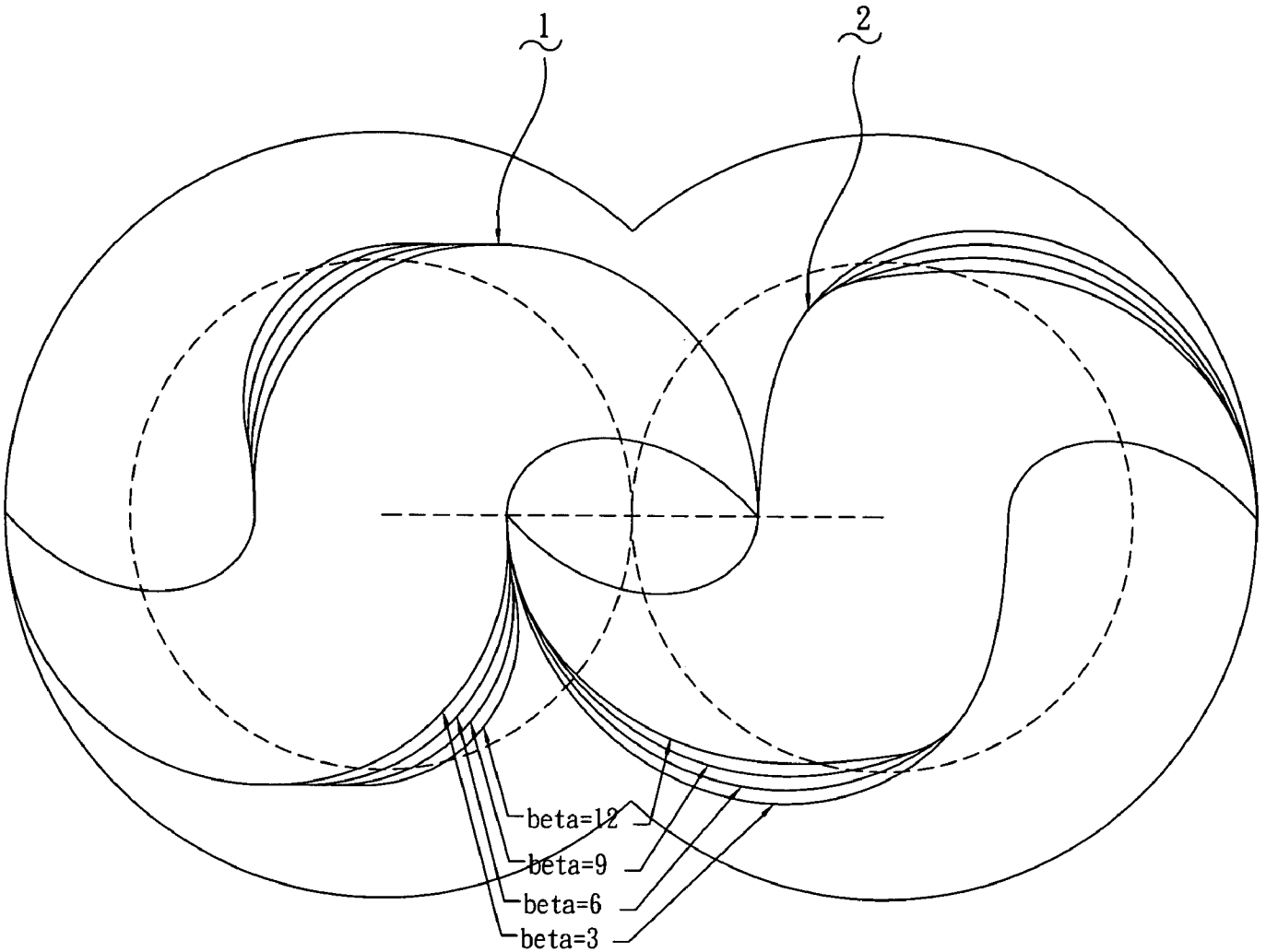
FIG. 7 is a sketch view of the defined rotor profile varying, where central angle $\beta$ thereof is 3°, 6°, 9°, 12°.
Figure 9:
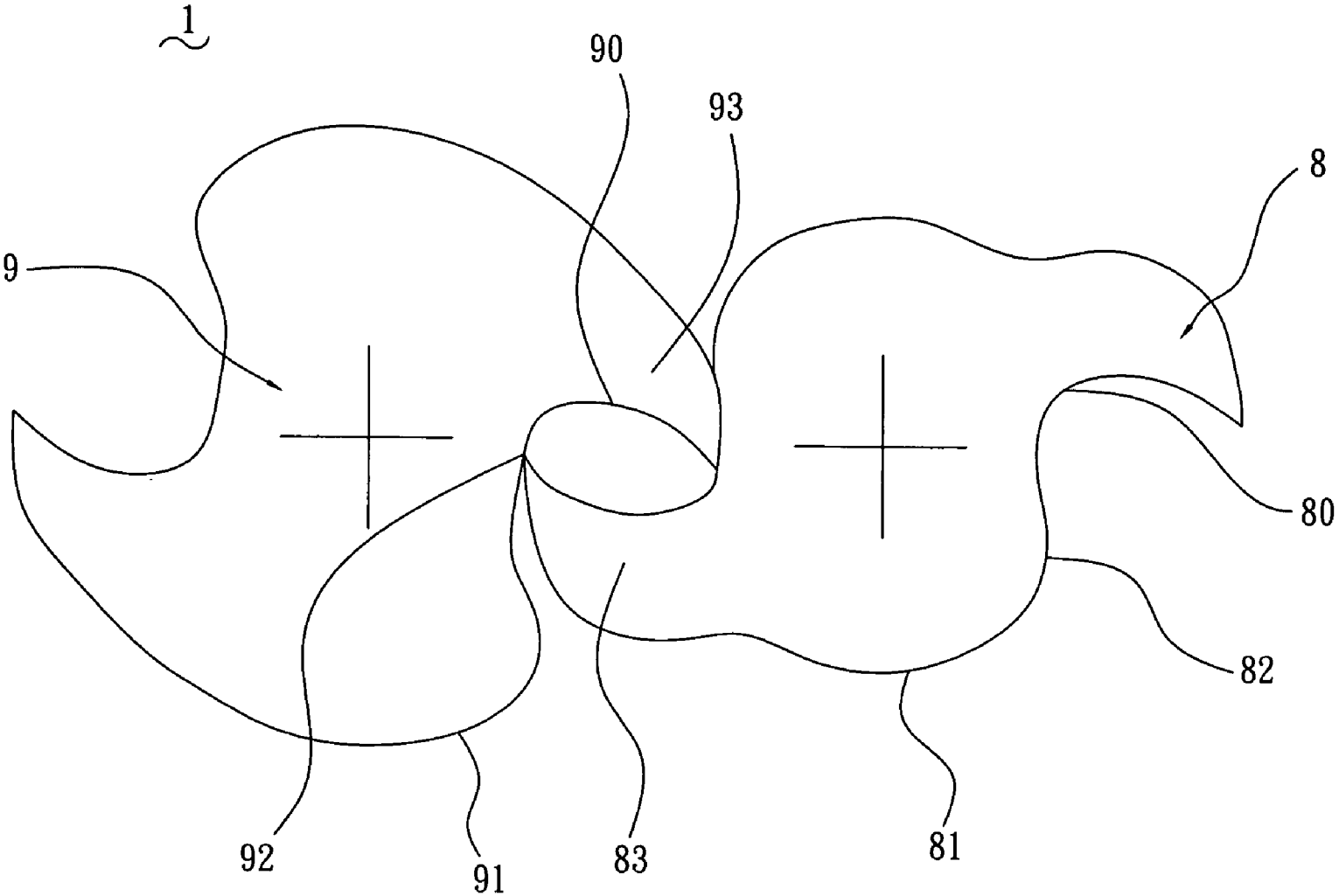
FIG. 9 is the planar view of a rotor mechanism of the U.S. Pat. No. 5,149,256.

Referring to FIGS. 6 and 7, the maximum radius R of the defined rotor 1 is 60 mm, and the width of the defined rotor 1 is 85 mm, while the first central angle α and the second central angle β are 3°, 6°, 9°, 12°, respectively. The profile of the defined rotor 1 varies with different first central angle α and second central angle β. As clearly shown in FIG. 6, with the first central angle α becoming larger, outward sides of the lobes of the defined rotor 1 become larger, and outward sides of the lobes of the conjugate rotor 2 become smaller. As clearly shown in FIG. 7, with the second central angle β becoming larger, another outward sides of the lobes of the defined rotor 1 become larger, and another outward sides of the lobes of the conjugate rotor 2 become smaller. FIG. 8 is a table collecting applications of the defined rotor 1 and the conjugate rotor 2 in FIGS. 5 through 7, where the design parameters of width D, the first central angle α and second central angle β vary, resulting in different radius $r_B$ and $r_C$, and correspondingly profiles of the defined rotor 1 and the conjugate rotor 2 vary.

During the design process described above the defined rotor 1 and the conjugate rotor 2 intermesh to each other from carryover to suction and from exhaust to the end of the completed operation period, operation curves of the defined rotor 1 and the conjugate rotor 2 smoothly connect, eliminating noise and vibration and enhancing compression ratio and transporting volume.

It is understood that the invention may be embodied in other forms without departing from the spirit thereof. Thus, the present examples and embodiments are to be considered in all respects as illustrative and not restrictive, and the invention is not to be limited to the details given herein.

What is claimed is:

1. A double-lobe type rotor design process, being adapted for forming a defined rotor and a conjugate rotor intermeshing and conjugating to each other, comprising:

a process for forming a defined rotor, including:

designating maximum radius R and width D of the defined rotor, pitch circles of the defined rotor and the conjugate rotor with a pitch circle radius Rp and a first center t1 and a third center t3 respectively, wherein a distance between the center t1 and the third center t3 is 2Rp, the pitch circle radius Rp is smaller than R, and R is in appropriate ratio with respect to Rp; designating the first center t1 as a center of the defined rotor, a reference horizontal line h1 being defined through the first center t1 and the third center t3 as assistant line, a base point p0 on the reference horizontal line h1 being spaced a distance R from the first center t1, a conjugate curve E' is created when the base point p0 rotating about the first center t1, a curve E being drawn symmetrically to the conjugate curve E' about the tangent point p7 of the two pitch circles of defined rotor and conjugate rotor, the curve E serving as a portion of a first lobe of the defined rotor, third point p3 being the intersection of curve E and horizontal line h1;

determining a first point p1 on a profile curve of the defined rotor 1 being defined by a first central angle α and the first center t1 and a radius of R, a first arc A being defined between the base point p0 and the first point p1 and smoothly connecting with the curve E;

taking a second line h2 being defined by the reference horizontal line h1 and the first central angle α, a second center t2 being located on the second line h2 and being spaced a distance $r_B$ apart from the first point p1, $r_B$ being defined by a trigonometric function equation, a second arc B being defined with a center of t2 and a radius of $r_B$ and connecting with the first point p1 and a second point p2, the second point p2 being located on a vertical line through the second center t2 and over the second center t2, the second arc B serving as a portion of the first lobe of the defined rotor; taking the third center t3 of the pitch circle of the conjugate rotor 2 being located on the reference horizontal line h1 and being spaced a distance 2Rp apart from the first center t1, a fourth point p4 being defined by a second central angle β and a circle with a center of t3 and a radius of R, a third arc F being defined by connecting with the third point p3 and the fourth point p4; taking a third line h3 being defined by the reference horizontal line h1 and a second central angle β, a fourth center t4 being located on the third line h3 and being spaced a distance $r_C$ apart from the fourth point p4, $r_C$ being defined by a trigonometric function equation, a fourth arc C being defined with a center of t4 and a radius of $r_C$ and connecting with the fourth point p4 and a fifth point p5, the fifth point p5 being located on a vertical line through the fourth center t4 and under the fourth center t4;

taking a second horizontal line Y being defined by connecting the second point p2 and a seventh point p6 which is symmetric to the fifth point p5 about the first center t1;

connecting the curve E, the first arc A, the second arc B, the third arc F, the fourth arc C and the horizontal line Y together to form a profile of the first lobe of the defined rotor, a profile of a second lobe of the defined rotor being drawn symmetrically to the profile of the first lobe;

a process for forming the conjugate rotor, including: creating the conjugate rotor by connecting respective conjugate curves of the curve E, the first arc A, the second arc B, the third arc F, the fourth arc C and the horizontal line Y.

2. The double-lobe type rotor design process as claimed in claim 1, wherein the $r_B$ is defined by following equation, and R is the maximum radius of the defined rotor 1, namely, the distance between the first center t1 and the first point p1.

$$r_B + (R - r_B)\sin\alpha = \frac{D}{2}$$

$$r_B = \frac{D/2 - R\sin\alpha}{1 - \sin\alpha}$$

3. The double-lobe type rotor design process as claimed in claim 1, wherein the radius $r_C$ is defined by the following equation, and R is the maximum radius of the defined rotor 1, namely, the distance between the center t4 and the fourth point p4.

$$r_C + (R + r_C)\sin\beta = \frac{D}{2}$$

$$r_C = \frac{D/2 - R\sin\beta}{1 + \sin\beta}$$

4. The double-lobe type rotor design process as claimed in claim 1, wherein the maximum radius R of the defined rotor and the pitch circle radius Rp are in a ratio R=3Rp/2.

* * * * *